US007074098B1

(12) United States Patent
Acosta, Jr.

(10) Patent No.: US 7,074,098 B1
(45) Date of Patent: Jul. 11, 2006

(54) AQUATIC BODY BOARD

(76) Inventor: Gustavo Adolfo Acosta, Jr., P.O. Box 247, Hawi, HI (US) 96719

( * ) Notice: Subject to any disclaimer, the term of this patent is extended or adjusted under 35 U.S.C. 154(b) by 0 days.

(21) Appl. No.: 11/258,712

(22) Filed: Oct. 26, 2005

(51) Int. Cl.
*B63B 1/00* (2006.01)

(52) U.S. Cl. ..... 441/65

(58) Field of Classification Search ..... 441/65, 441/74, 79
See application file for complete search history.

(56) References Cited

U.S. PATENT DOCUMENTS

| | | | | |
|---|---|---|---|---|
| 2,389,729 | A | 11/1945 | Howland | |
| 3,111,695 | A | 11/1963 | Kelly, Jr. | |
| 3,930,455 | A | 1/1976 | Bremer | |
| 4,302,860 | A | 12/1981 | Puch | |
| 4,619,619 | A | 10/1986 | Muse, Jr. | |
| 4,629,435 | A | 12/1986 | Pitcairn | |
| 4,666,171 | A | 5/1987 | Sellers | |
| 4,857,025 | A * | 8/1989 | Brown et al. | 441/65 |
| D305,145 | S | 12/1989 | Shanelec | |
| D410,515 | S | 6/1999 | Alexander | |
| 6,203,389 | B1 * | 3/2001 | Pearson | 441/65 |
| 6,595,151 | B1 * | 7/2003 | Keller | 114/39.14 |
| 2004/0152377 | A1 | 8/2004 | Katz et al. | |

* cited by examiner

*Primary Examiner*—Stephen Avila
(74) *Attorney, Agent, or Firm*—Michael R. McKenna

(57) ABSTRACT

An aquatic body board with enhanced maneuverability, speed and comfort having a tapered upturned nose for maneuvering over rough seas and avoiding deadheading which does not impede paddling, a concave valley extending along the length of the top surface of the board to comfortably and securingly accommodate the body of the user, at least one concave channel on the bottom surface to reduce friction with the water and at least one fin to aid stability and maneuverability.

22 Claims, 5 Drawing Sheets

AQUATIC BODY BOARD

BACKGROUND OF THE INVENTION

This invention relates to an aquatic body board with enhanced maneuverability, speed and comfort. The top surface of the aquatic body board has a concave valley extending along the length of the board which is preferably sloped downwardly toward the trailing end. The bottom surface of the aquatic body board has at least one concave channel to aid stability and reduce friction with the water. Also provided on the bottom surface of the aquatic body board is at least one fin. The at least one fin stabilizes the board laterally and positively affects turning maneuvers. The front end of the aquatic body board has an upturned nose for maneuvering over rough seas and avoiding deadheading.

The aquatic body board preferably has a central elongated section and two shoulder sections. The central elongated section extends from the leading end to the trailing end and is generally flat with an uplifted nose segment proximate the leading end. The nose segment has a front end and a back end, and it tapers in width from the back end to the front end. The top surface has a valley extending longitudinally from the nose segment to the trailing end. The trailing end of the central elongated section has a rear edge comprising at least one inward curve. The two shoulder sections extend laterally from each side of the central elongated section from the nose segment to the trailing end with each of the two shoulder sections forming an extended tail at the trailing end.

Previous aquatic body boards were slow, and lacked maneuverability and comfort. To alleviate these problems, and others which will become apparent from the disclosure which follows, the present invention conveniently provides a concave valley for the user to rest on while providing a tapered nose to allow the user to more easily paddle. Paddling is further enhanced by removing the leash from the user's wrist and providing a leg leash with attached to the board near the stern. An inwardly curved trailing end allows the user to kick freely while in a resting position on the board.

ADVANTAGES OF THIS INVENTION

The aquatic body board of the present invention is easy to maneuver and comfortable for the user. The board is buoyant and light weight. Unlike a surf board, the aquatic body board allows the user to propel the board forward by kicking from behind as well as by paddling and improved hydroplaning results. Users can paddle and kick to propel the aquatic body board faster and catch wave action before it dissipates. The trailing end of the board is recessed for unrestricted user kicking action. The upper valley is sloped downwardly toward the rear of the device thus allowing the front end of the board to rise and the user's legs to be disposed in the water for improved kicking action. The valley also serves to help secure the user's body on the top of the board. The valley on the top surface of the board is designed to accommodate and center the body of the user and lower the center of gravity. It is comfortable to lay on and maneuver with your feet.

The uplifted nose also avoids deadheading—eliminating having the front end sink, while the bottom surface has concave channels that stabilize and reduce drag. The board is highly maneuverable due to the bottom surface having multiple hulls which configuration allows for more concise turning. Additionally, the extended tail at the trailing end at each of the two shoulder sections, aids stability and steering.

Most body boards have a leash which connects the body board to the user's wrist. Placement of the leash on the board is therefore normally on the front. The unique placement of the means for leashing adjacent the rear end of the board allows the user to secure the board to a leg below the knee, thus freeing up the wrist and arms for paddling.

These together with other objects of the invention, along with the various features of novelty which characterize the invention are pointed out with particularity in the claims annexed to and forming a part of this disclosure. For a better understanding of the invention, its operating advantages and the specific objectives attained by its uses, reference should be had to the accompanying drawings and descriptive matter in which there is illustrated preferred embodiments of the invention.

Still other advantages will be apparent from the disclosure that follows.

SUMMARY OF THE INVENTION

The invention relates to an aquatic body board with a leading end and a trailing end comprising a central elongated section and two shoulder sections. The central elongated section extends from the leading end to the trailing end and has a top surface and a bottom surface. The central elongated section is generally flat with an uplifted nose segment proximate the leading end. The nose segment has a front end and a back end, and it tapers in width from the back end to the front end. The nose segment is symmetrically rounded. The top surface has a valley extending longitudinally from the nose segment to the trailing end. The valley is preferably symmetrical about the longitudinal centerline. The bottom surface has at least one channel extending from the nose segment to the trailing end. The trailing end of the central elongated section has a rear edge comprising at least one inward curve. The two shoulder sections extend laterally from each side of the central elongated section from the nose segment to the trailing end with each of the two shoulder sections forming an extended tail at the trailing end.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Preferred embodiments of the invention are described hereinafter with reference to the accompanying drawing wherein.

DETAILED DESCRIPTION OF THE INVENTION

Figure 1:
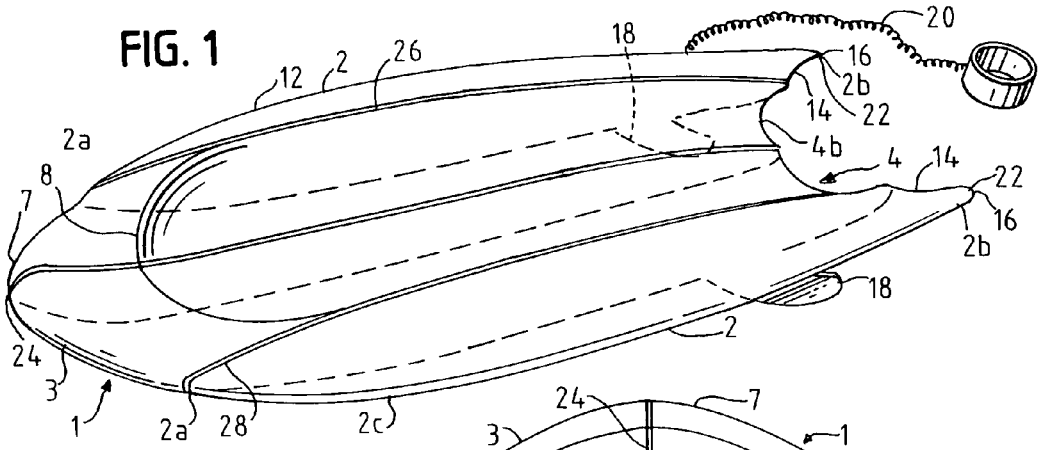
FIG. 1 is a perspective view of the aquatic body board showing a valley extending longitudinally on a top surface to accommodate the body of a user, said body board having fins and a means for leashing the body board to the user.
Figure 2:
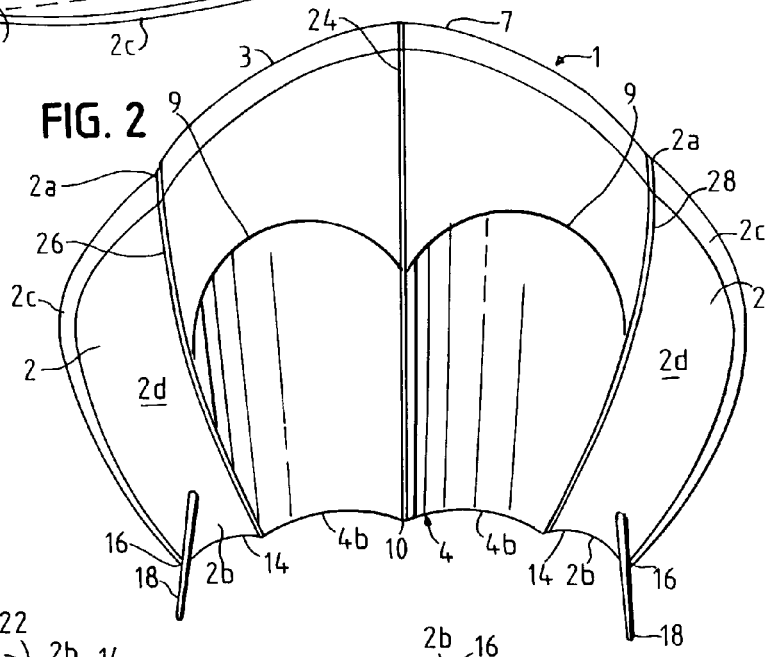
FIG. 2 is an elevated bottom perspective view taken from the front end of the aquatic body board showing a pair of channels extending from a nose segment to the trailing end of the aquatic body board.
Figure 3:
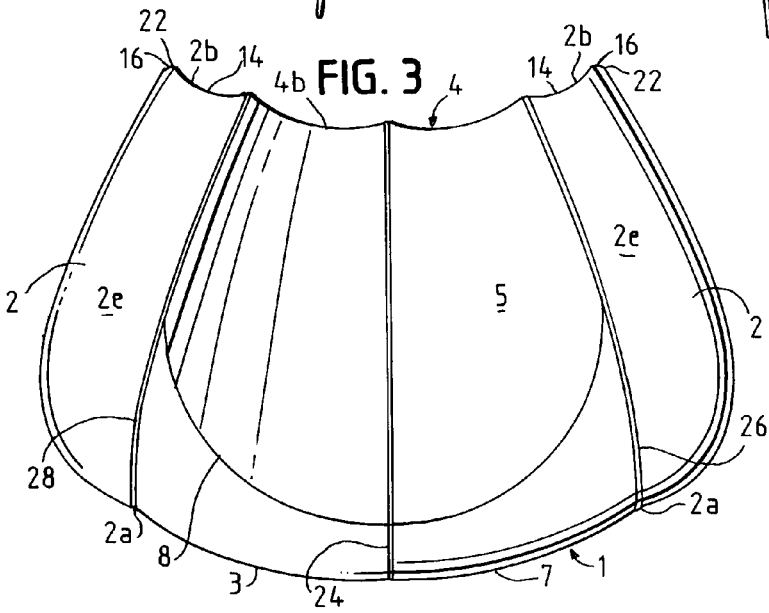
FIG. 3 is a lowered perspective view of the aquatic body board looking down on the top surface from the leading end showing the central valley disposed on the top surface of the central elongated section and showing a shoulder section extending laterally from each side of the central elongated section from the nose segment to the trailing end.
Figure 4:
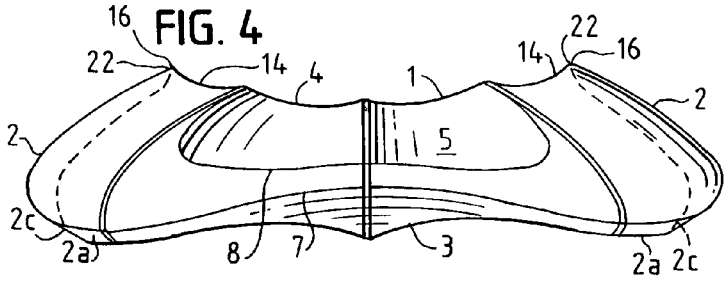
FIG. 4 is a perspective view looking at the aquatic body board from the front end showing an uplifted nose segment and a central valley on the top surface for the user's body and contoured other side edges of the shoulder sections.
Figure 5:
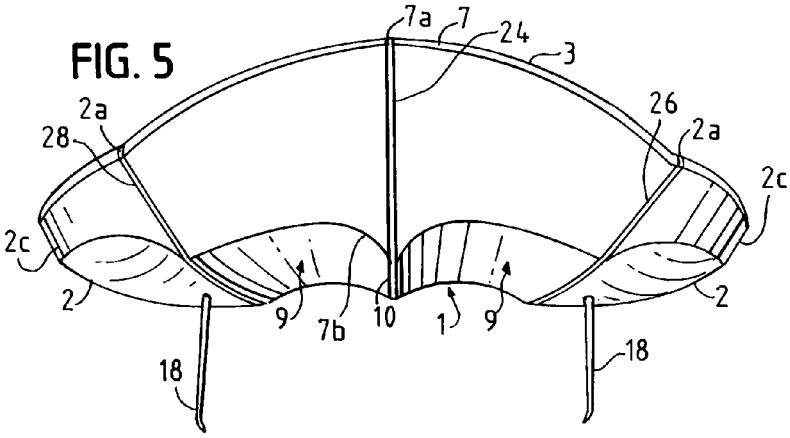
FIG. 5 is a perspective view taken from the front end of the aquatic body board showing the central ridge of the bottom of the board and the two channels extending from the nose segment that are adjacent to the ridge.
Figure 6:
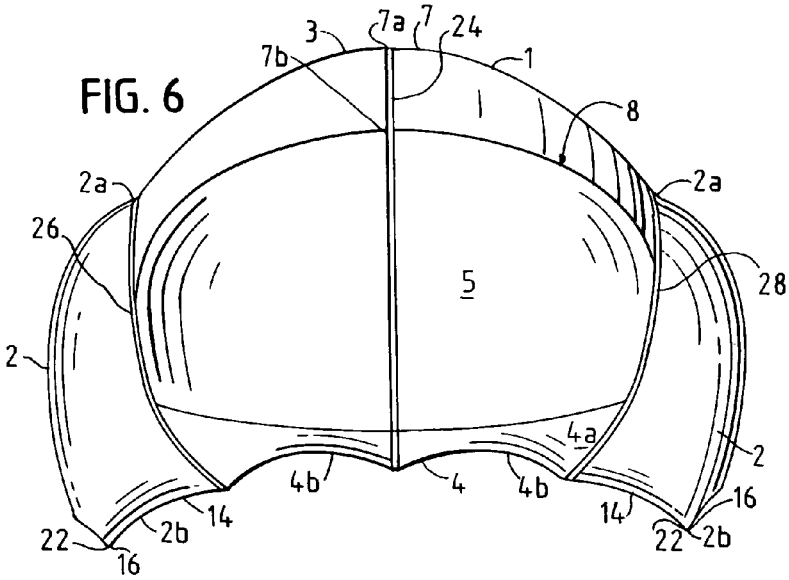
FIG. 6 is a perspective view of the aquatic body board taken from the trailing end and looking downwardly showing details of the top surface and trailing end.
Figure 7:
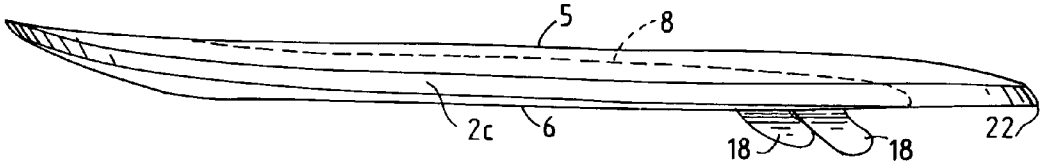
FIG. 7 is a side perspective view of the aquatic body board showing the uplifted nose segment and a dashed line indicating the center line of the valley on the top surface.

The preferred embodiments depicted in the drawing comprise an aquatic body board. Without departing from the generality of the invention disclosed herein and without limiting the scope of the invention, the discussion that follows, will refer to the invention as depicted in the drawing.

The preferred embodiments of the apparatus depicted in the drawing comprise an aquatic body board with a leading end in the front and a trailing end at the rear which comprises a central elongated section 1 and two shoulder sections 2. The central elongated section 1 extends from the leading end 3 to the trailing end 4 and has a top surface 5 and a bottom surface 6. The central elongated section 1 is generally flat with an uplifted nose segment 7 proximate the leading end 3. The nose segment 7 has a front end 7*a* and a back end 7*b*, and it tapers in width from the back end 7*b* to the front end 7*a*. The top surface 5 has a valley 8 extending longitudinally from the nose segment 7 to the trailing end 4. The valley 8 is preferably symmetrical about the longitudinal centerline and is preferably concave and sloping downwardly toward the trailing end 4. The bottom surface 6 has at least one channel 9 extending from the nose segment 7 to the trailing end 4. The trailing end 4 of the central elongated section 1 has a rear edge 4*a* comprising at least one inward curve 4*b*. The two shoulder sections 2 may be convex and extend laterally from each side of the central elongated section 1 from the nose segment 7 to the trailing end 4 with each of the two shoulder sections 2 forming an extended tail at the trailing end 4.

Preferably, the front end 7*a* of the nose segment 7 corresponds to the leading end 3, and each of the top surface 5 and the bottom surface 6 of the nose segment 7 is sloped upwardly from the back end 7*b* to the front end 7*a*. Furthermore, the bottom surface 6 of the central elongated section 1 may have a central longitudinal ridge extending from the nose segment 7 to the trailing end 4, and the at least one channel is preferably two symmetrical channels 9. Each of the two symmetrical channels 9 may be adjacent to the central longitudinal ridge 10.

In a preferred embodiment of the aquatic body board, the valley 8 extends longitudinally from the back end 7*b* of the nose segment 7 to the trailing end 4. In other preferred embodiments of the aquatic body board, the valley 8' and 8" extends longitudinally from one of a plurality of mid-positions of the nose segment 7 to the trailing end 4, as best shown in FIG. 10.

Figure 9:
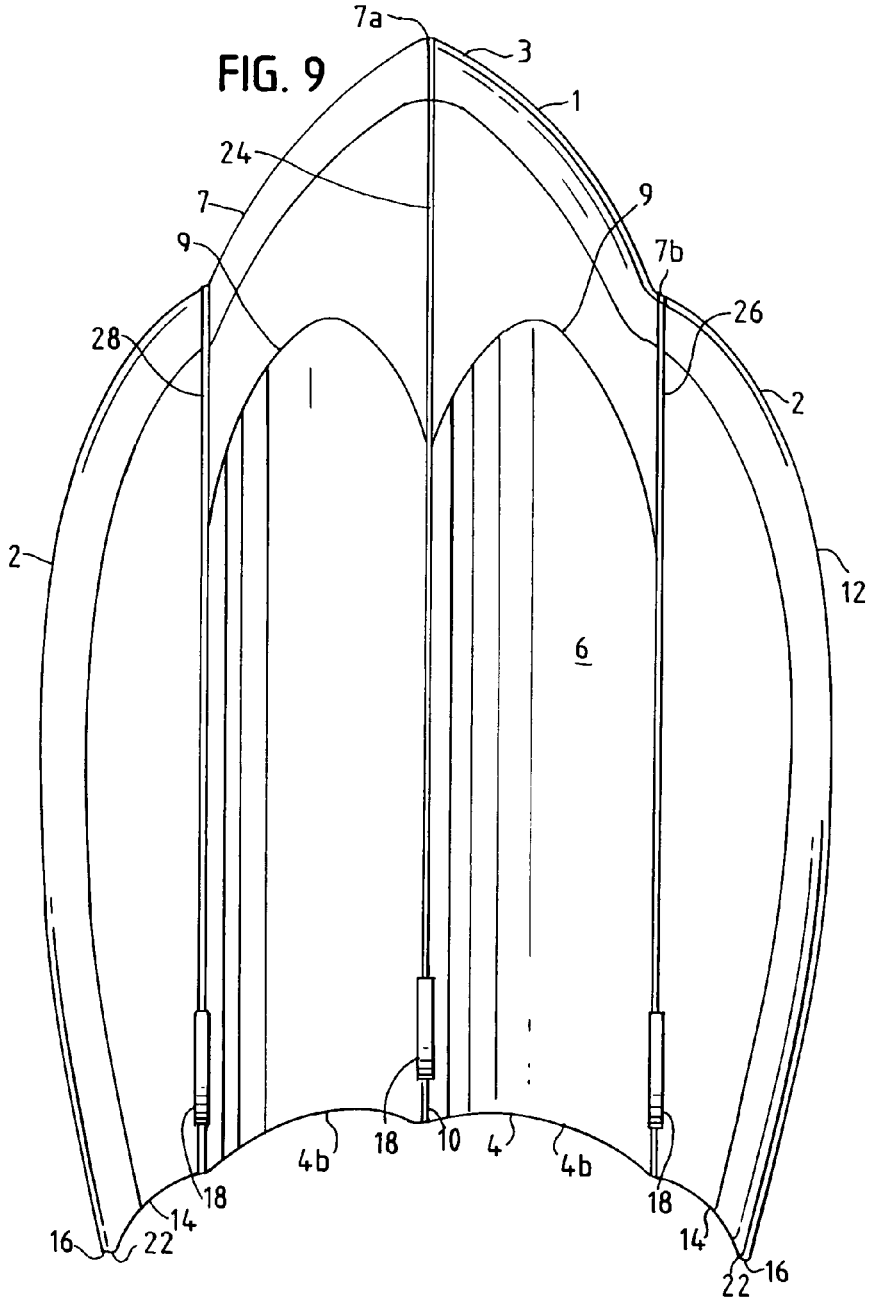
FIG. 9 is a bottom plan view of the aquatic body board showing a width of the outer edge of the shoulders proximate the trailing end not substantially exceeding the width of the body board at the leading end, and further showing three fins disposed on the bottom surface of the board.
Figure 8:
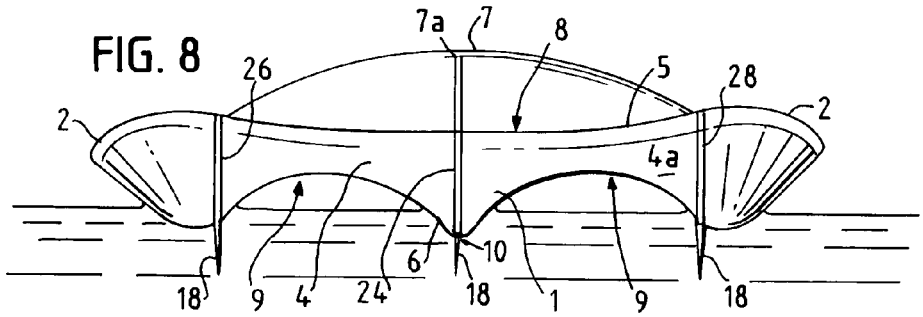
FIG. 8 is a rear elevation view of the aquatic body board of the present invention showing three fins and two channels disposed on the bottom surface of the board and showing the central valley on the top surface and the uplifted nose.

Additionally, each of the two shoulder sections 2 may have a bow end 2*a*, a stern end 2*b* and an outer side edge 2*c*, and the bow end 2*a* of each of the two shoulder sections 2 may be contoured to reduce drag. Furthermore, the outer side edge 2*c* of each of the two shoulder sections 2 may be contoured to reduce drag. As shown in FIG. 9, a width measured perpendicular to the longitudinal axis of the board between the outer side edge 2*c* of each of the two shoulder sections 2 may increase from the bow end 2*a* to a medial section 12 and decrease from the medial section 12 to the stern end 2*b*. Referring to FIG. 10, a maximum dimension of the width may be substantially less than an overall longitudinal length of the board. In a preferred embodiment, an optimum width is twenty-four inches and an optimum overall length is forty-four inches.

The aquatic body board of the present invention may have the outer side edge 2*c* of each of the two shoulder sections 2 being skewed outwardly from a lower surface to an upper surface 2*e* of each of the two shoulder sections 2 relative to a vertical datum.

Figure 10:
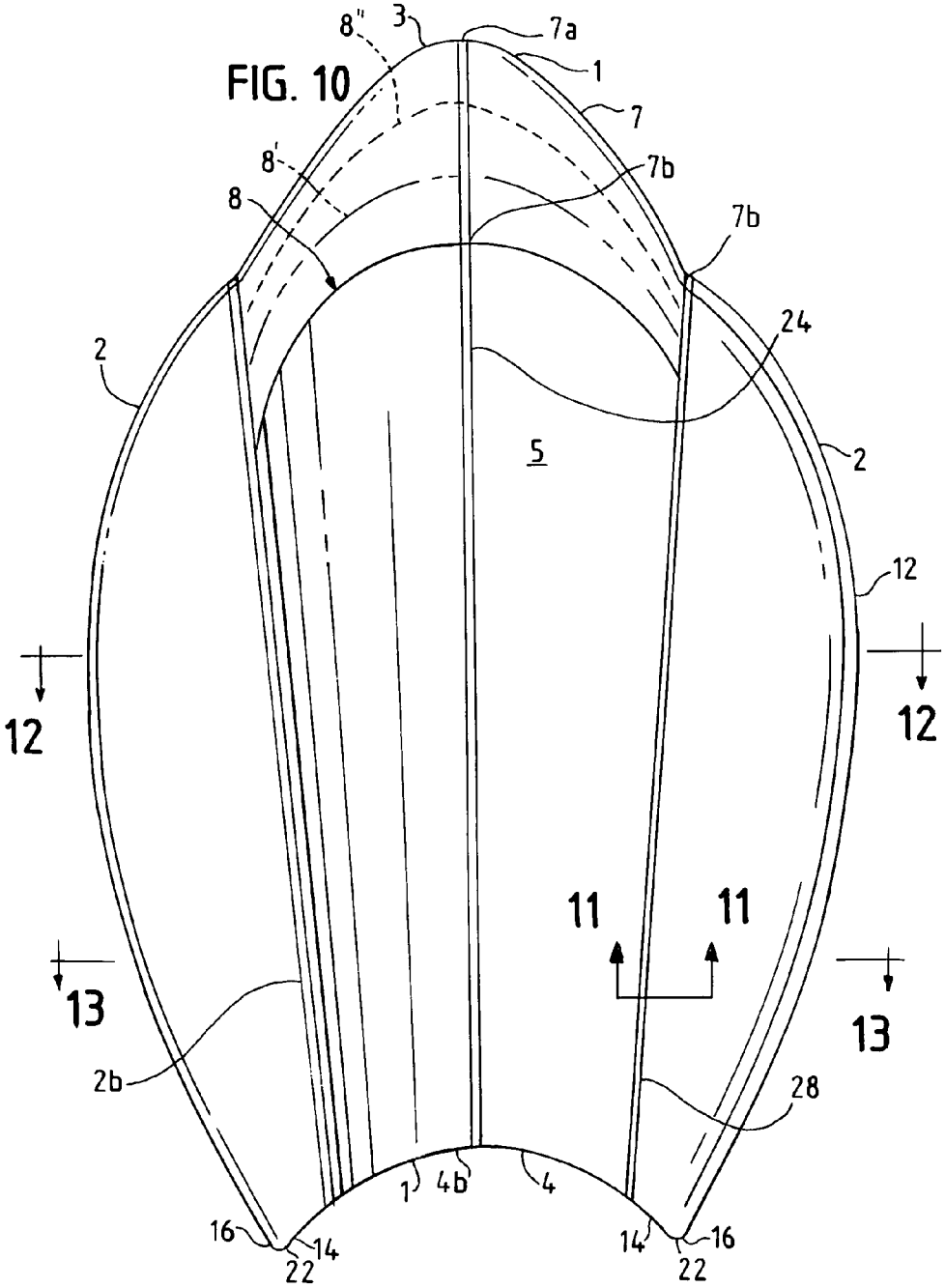
FIG. 10 is a bottom view of the aquatic body board showing the width of the leading end of the body board not substantially exceeding the width of the shoulders at the trailing end and further showing the curved recess and the at least one inward curve having a similar radius of curvature as measured from a common point.
Figure 11:
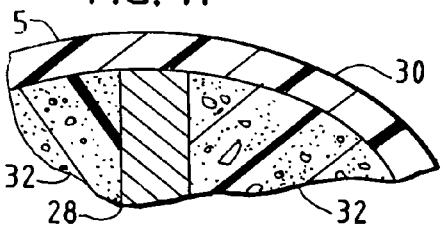
FIG. 11 is a cross sectional view of 11—11 of FIG. 10 showing one of the stringers disposed between sections of foam covered by a coating on the surface of the aquatic body board.
Figure 12:
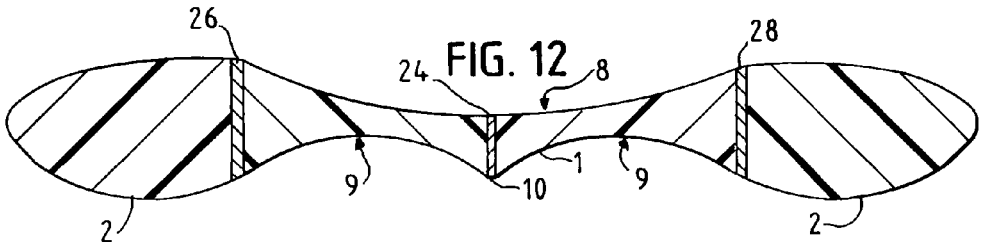
FIG. 12 is a cross sectional view of line 12—12 of FIG. 10 showing the central valley on the top surface of the board and the two channels on the bottom surface thereof.
Figure 13:
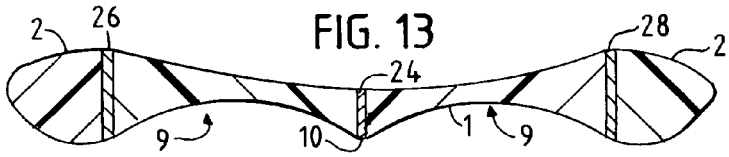
FIG. 13 is a cross sectional view taken along 13—13 of FIG. 10.
Figure 14:
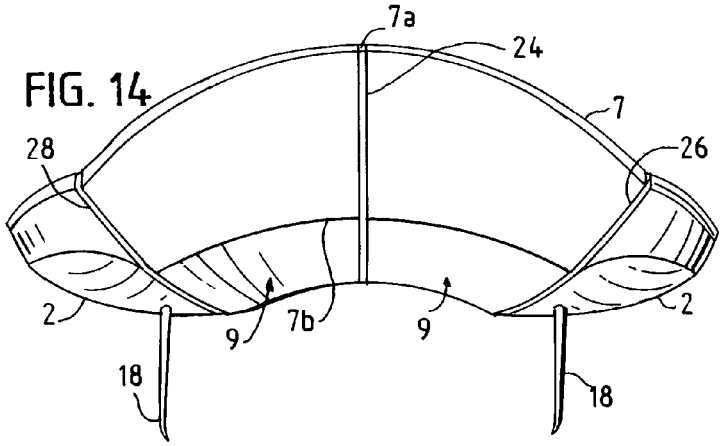
FIG. 14 is a perspective view taken from the front which shows the bottom of the board with one channel extending longitudinally thereon.
Figure 15:
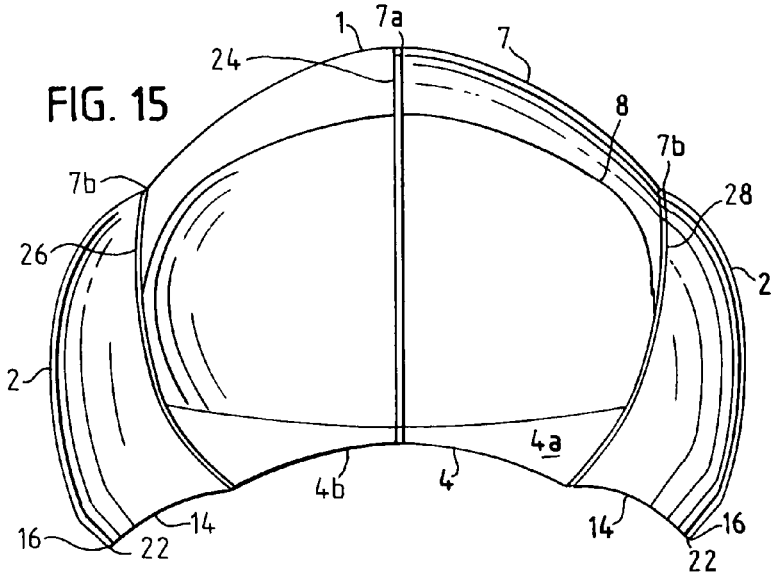
FIG. 15 is a perspective view of the aquatic body board taken from the trailing end and looking downwardly showing details of the top surface and trailing end of the central elongated section.

Referring to FIG. 10, a width measured perpendicular to the longitudinal axis of the board between the outer side edge 2*c* of each of the two shoulder sections 2 proximate the bow end 2*a* may not substantially exceed a width measured perpendicular to the longitudinal axis of the board between the outer side edge 2*c* of each of the two shoulder sections 2 proximate the stern end 2*b*. In another design choice as shown in FIG. 9 to accommodate a different body configuration, a width measured perpendicular to the longitudinal axis of the board between the outer side edge 2*c* of each of the two shoulder sections 2 proximate the stern end 2*b* may not substantially exceed a width measured perpendicular to the longitudinal axis of the board between the outer side edge 2*c* of each of the two shoulder sections 2 proximate the bow end 2*a*.

A preferred feature is shown in FIG. 9, wherein the stern end 2*b* of each of the two shoulder sections 2 has a curved recess 14 and wherein the extended tail comprises a longitudinal projection 16 at the outer edge of the curved recess 14 for stabilizing the board. Additionally, the curved recess 14 of each of the two shoulder sections 2 may extend from the longitudinal projection 16 to the at least one inward curve 4*b*. Moreover, the curved recess 14 and the at least one inward curve 4*b* may have an identical radius of curvature as measured from a common point as shown in FIG. 10.

The aquatic body board may further include at least one generally longitudinally aligned fin 18 projecting downwardly from at least one of the bottom surface 6 of the central elongated section 1 and a lower surface 2*d* of at least one of the two shoulder sections 2, and the at least one generally longitudinally aligned fin 18 is disposed proximate the trailing end 4 of the board. Preferably, the at least one generally longitudinally aligned fin 18 comprises two fins, one of the two fins projecting downwardly from the lower surface 2*d* of one of the two shoulder sections 2 proximate the trailing end 4 of the board and the other of the two fins projecting downwardly from the lower surface 2*d* of the other of the two shoulder sections 2 proximate the trailing end 4 of the board.

The aquatic body board may also have means for leashing 20 the board to the body of a user. The means for leashing 20 may be attached to one of the top surface 5 of the central elongated section 1 proximate one of the two shoulder sections 2 and an upper surface 2*e* of one of the two shoulder sections 2, and the means for leashing 20 is preferably disposed proximate the trailing end 4 of the board. As shown in FIG. 1, the means for leashing 20 may connect the board to the leg below the knee of the user.

In a preferred embodiment of the aquatic body board of this important invention has a leading end 3 in the front and a trailing end 4 at the rear, and it comprises a central elongated section 1 and two shoulder sections 2. The central elongated section 1 may extend from the leading end 3 to the trailing end 4 with a top surface 5 and a bottom surface 6. The central elongated section 1 is generally flat with a uplifted nose segment 7 proximate the leading end 3. The nose segment 7 has a front end 7*a* corresponding to the leading end 3 and a back end 7*b*, and each of the top surface 5 and the bottom surface 6 of the nose segment 7 is sloped upwardly from the back end 7*b* to the front end 7*a*. The nose segment 7 tapers in width from the back end 7*b* to the front end 7*a*. The top surface 5 has a symmetrical valley 8 extending longitudinally from the nose segment 7 to the trailing end 4. The bottom surface 6 has a central longitudinal ridge 10 extending from the nose segment 7 to the trailing end 4, and two symmetrical channels 9 extending from the nose segment 7 to the trailing end 4. Each of the two symmetrical channels 9 is adjacent to the central longitudinal ridge 10. The trailing end 4 of the central elongated section 1 has a rear edge 4*a* comprising at least one inward curve 4*b*. The two shoulder sections 2 extend laterally from each side of the central elongated section 1 from the nose segment 7 to the trailing end 4 with each of the two shoulder sections 2 forming an extended tail 22 at the trailing end 4.

The aquatic body board has a leading end 3 in the front and a trailing end 4 at the rear and preferably comprises a central longitudinal stringer 24, a first longitudinal stringer 26, and a second longitudinal stringer 28, a central elongated section 1, two shoulder sections 2, and a smooth coating 30. Each stringer extends from the leading end 3 to the trailing end 4. The longitudinal stringers (24, 26, 28) may comprise upright elongated timber boards at least partially embedded in the aquatic body board. As shown in FIGS. 8 and 11–13, the longitudinal stringers preferably comprise upright elongated timber boards embedded in the aquatic body board. The stringers are preferably streamlined so as not to protrude from the surfaces of the board. The central elongated section 1 preferably extends from the leading end 3 to the trailing end 4 with a top surface 5 and a bottom surface 6. The central elongated section 1 is generally flat with a uplifted nose segment 7 proximate the leading end 3. The nose segment 7 has a front end 7*a* corresponding to the leading end 3 and a back end 7*b*, and each of the top surface 5 and the bottom surface 6 of the nose segment 7 is preferably sloped upwardly from the back end 7*b* to the front end 7*a*. The nose segment 7 advantageously tapers in width from the back end 7*b* to the front end 7*a*.

As shown in FIGS. 1, 3, 4, 6–8 and 10, the top surface 5 has a symmetrical valley 8 extending longitudinally from the nose segment 7 to the trailing end 4. The bottom surface 6 has a central longitudinal ridge 10 extending from the nose segment 7 to the trailing end 4. The ridge is supported by the central longitudinal stringer 24, and two symmetrical channels 9 extend from the nose segment 7 to the trailing end 4. Each of the two symmetrical channels 9 is adjacent to the central longitudinal ridge 10. The trailing end 4 of the central elongated section 1 has a rear edge 4*a* comprising at least one inward curve 4*b*.

The two shoulder sections 2 extend laterally from each side of the central elongated section 1 from the nose segment 7 to the trailing end 4 with each of the two shoulder sections 2 forming an extended tail 22 at the trailing end 4. Each side of the central elongated section 1 comprises one of the first longitudinal stringer 26 and the second longitudinal stringer 28. The central elongated section 1 comprises a buoyant foam disposed, which may be heat bonded, adhesively bonded or attached using other commercially standardized techniques, between the central longitudinal stringer 24 and each of the first longitudinal stringer 26 and the second longitudinal stringer 28. One of the two shoulder sections 2 comprises a buoyant foam 32 extending from and attached to one of the first longitudinal stringer 26 and the second longitudinal stringer 28, and the other of the two shoulder sections 2 comprises a buoyant foam 32 extending from and attached to the other of the first longitudinal stringer 26 and the second longitudinal stringer 28. Finally, the aquatic body board may be covered with a smooth coating 30.

The composition for the aquatic body board is contemplated to be standard surf board materials including foam blanks and cedar stringers with fiberglass and gloss coating. Fins 18 with five inch bases and three inches long can be disposed on the trailing end 4 of the device. It is expected that the body board will be manufactured in three sizes: small, medium and large, to accommodate small, medium and large users.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

My invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, including variations in size, materials, shape, form, function and manner of operation, assembly and use, and all equivalent relationships to those illustrated in the drawings and described in the specification, that would be deemed readily apparent and obvious to one skilled in the art, are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new and desired by Letters Patent of the United States is:

1. An aquatic body board with a leading end in the front and a trailing end at the rear comprising:

a. a central elongated section extending from the leading end to the trailing end with a top surface and a bottom surface, i. said central elongated section being generally flat with a uplifted nose segment proximate the leading end, said nose segment having a front end and a back end, said nose segment tapers in width from the back end to the front end, (1) the top surface has a valley extending longitudinally from the nose segment to the trailing end, (2) the bottom surface has at least one channel extending from the nose segment to the trailing end, (3) the trailing end of the central elongated section has a rear edge comprising at least one inward curve; and b. two shoulder sections extending laterally from each side of the central elongated section from the nose segment to the trailing end with each of said two shoulder sections forming an extended tail at the trailing end.

2. The aquatic body board of claim 1, wherein the at least one channel comprises two symmetrical channels.

3. The aquatic body board of claim 1, wherein the valley is concave and slopes downwardly toward the trailing end.

4. The aquatic body board of claim 1, wherein the front end of the nose segment corresponds to the leading end, and each of the top surface and the bottom surface of the nose segment is sloped upwardly from the back end to the front end.

5. The aquatic body board of claim 2, wherein the bottom surface of the central elongated section has a central longitudinal ridge extending from the nose segment to the trailing end, and each of said two symmetrical channels is adjacent to the central longitudinal ridge.

6. The aquatic body board of claim 1, wherein the valley extends longitudinally from the back end of the nose segment to the trailing end.

7. The aquatic body board of claim 1, wherein each of the two shoulder sections has a bow end, a stern end and an outer side edge, and the bow end of each of the two shoulder sections is contoured to reduce drag.

8. The aquatic body board of claim 7, wherein the outer side edge of each of the two shoulder sections is contoured to reduce drag.

9. The aquatic body board of claim 8, wherein a width measured perpendicular to the longitudinal axis of the board between the outer side edge of each of the two shoulder sections increases from the bow end to a medial section and decreases from the medial section to the stern end.

10. The aquatic body board of claim 9, wherein a maximum dimension of the width is substantially less than an overall longitudinal length of the board.

11. The aquatic body board of claim 8, wherein the outer side edge of each of the two shoulder sections is skewed outwardly from a lower surface to an upper surface of each of the two shoulder sections relative to a vertical datum.

12. The aquatic body board of claim 8, wherein a width measured perpendicular to the longitudinal axis of the board between the outer side edge of each of the two shoulder sections proximate the bow end does not substantially exceed a width measured perpendicular to the longitudinal axis of the board between the outer side edge of each of the two shoulder sections proximate the stern end.

13. The aquatic body board of claim 8, wherein a width measured perpendicular to the longitudinal axis of the board between the outer side edge of each of the two shoulder sections proximate the stern end does not substantially exceed a width measured perpendicular to the longitudinal axis of the board between the outer side edge of each of the two shoulder sections proximate the bow end.

14. The aquatic body board of claim 7, wherein the stern end of each of the two shoulder sections has a curved recess and wherein the extended tail comprises a longitudinal projection at the outer edge of said curved recess for stabilizing the board.

15. The aquatic body board of claim 14, wherein the curved recess of each of the two shoulder sections extends from the longitudinal projection to the at least one inward curve.

16. The aquatic body board of claim 15, wherein the curved recess and the at least one inward curve have an identical radius of curvature as measured from a common point.

17. The aquatic body board of claim 1, further comprising at least one generally longitudinally aligned fin projecting downwardly from at least one of the bottom surface of the central elongated section and a lower surface of at least one of the two shoulder sections, and said at least one generally longitudinally aligned fin is disposed proximate the trailing end of the board.

18. The aquatic body board of claim 17, wherein the at least one generally longitudinally aligned fin comprises two fins, one of said two fins projecting downwardly from the lower surface of one of the two shoulder sections proximate the trailing end of the board and the other of said two fins projecting downwardly from the lower surface of the other of the two shoulder sections proximate the trailing end of the board.

19. The aquatic body board of claim 1, further comprising means for leashing the board to the body of a user, said means for leashing being attached to one of the top surface of the central elongated section proximate one of the two shoulder sections and an upper surface of one of the two shoulder sections, and said means for leashing is disposed proximate the trailing end of the board.

20. The aquatic body board of claim 19, wherein the means for leashing connects the board to a leg below the knee of the user.

21. An aquatic body board with a leading end in the front and a trailing end at the rear comprising:

a. a central elongated section extending from the leading end to the trailing end with a top surface and a bottom surface, i. said central elongated section being generally flat with a uplifted nose segment proximate the leading end, said nose segment having a front end corresponding to the leading end and a back end, and each of the top surface and the bottom surface of the nose segment being sloped upwardly from the back end to the front end, said nose segment tapers in width from the back end to the front end, (1) the top surface has a symmetrical valley extending longitudinally from the nose segment to the trailing end, (2) the bottom surface has a central longitudinal ridge extending from the nose segment to the trailing end, and two symmetrical channels extending from the nose segment to the trailing end, each of said two symmetrical channels being adjacent to the central longitudinal ridge;

(3) the trailing end of the central elongated section has a rear edge comprising at least one inward curve; and b. two shoulder sections extending laterally from each side of the central elongated section from the nose segment to the trailing end with each of said two shoulder sections forming an extended tail at the trailing end.

22. An aquatic body board with a leading end in the front and a trailing end at the rear comprising:

a. a central longitudinal stringer, a first longitudinal stringer, and a second longitudinal stringer, each stringer extending from the leading end to the trailing end;

b. a central elongated section extending from the leading end to the trailing end with a top surface and a bottom surface, i. said central elongated section being generally flat with a uplifted nose segment proximate the leading end, said nose segment having a front end corresponding to the leading end and a back end, and each of the top surface and the bottom surface of the nose segment being sloped upwardly from the back end to the front end, said nose segment tapers in width from the back end to the front end, (1) the top surface has a symmetrical valley extending longitudinally from the nose segment to the trailing end, (2) the bottom surface has a central longitudinal ridge extending from the nose segment to the trailing end, said ridge is supported by the central longitudinal stringer, and two symmetrical channels extending from the nose segment to the trailing end, each of said two symmetrical channels being adjacent to the central longitudinal ridge;

(3) the trailing end of the central elongated section has a rear edge comprising at least one inward curve; and c. two shoulder sections extending laterally from each side of the central elongated section from the nose segment to the trailing end with each of said two shoulder sections forming an extended tail at the trailing end, i. each side of the central elongated section comprises one of the first longitudinal stringer and the second longitudinal stringer, ii. the central elongated section comprises a buoyant foam disposed between the central longitudinal stringer and each of the first longitudinal stringer and the second longitudinal stringer, iii. one of the two shoulder sections comprises a buoyant foam extending from and attached to one of the first longitudinal stringer and the second longitudinal stringer, and the other of the two shoulder sections comprises a buoyant foam extending from and attached to the other of the first longitudinal stringer and the second longitudinal stringer; and d. the aquatic body board is covered with a smooth coating.

* * * * *